US006263718B1

(12) United States Patent
Buse et al.

(10) Patent No.: US 6,263,718 B1
(45) Date of Patent: Jul. 24, 2001

(54) TEMPERATURE CONTROL DURING CAN BODY IRONING

(75) Inventors: Dieter Buse, Swisttal-Odendorf; Willi Grandmann, Wolfenbuettel, both of (DE)

(73) Assignee: Schmalbac Lubeca AG, Ratingen (DE)

( * ) Notice: Subject to any disclaimer, the term of this patent is extended or adjusted under 35 U.S.C. 154(b) by 483 days.

(21) Appl. No.: 08/945,138

(22) PCT Filed: Apr. 9, 1996

(86) PCT No.: PCT/DE96/00623

§ 371 Date: Jan. 2, 1998

§ 102(e) Date: Jan. 2, 1998

(87) PCT Pub. No.: WO96/32213

PCT Pub. Date: Oct. 17, 1996

(30) Foreign Application Priority Data

Apr. 13, 1995 (DE) ..... 195 14 076

(51) Int. Cl.[7] ..... B21D 22/28
(52) U.S. Cl. ..... 72/342.92; 72/349
(58) Field of Search ..... 72/342.3, 342.7, 72/342.8, 342.92, 349

(56) References Cited

U.S. PATENT DOCUMENTS

| | | | | |
|---|---|---|---|---|
| 4,148,208 | | 4/1979 | Maeder | 72/342 |
| 4,502,313 | * | 3/1985 | Phalin et al. | 72/342.3 |
| 5,277,047 | * | 1/1994 | Herdzina | 72/342.92 |

FOREIGN PATENT DOCUMENTS

| | | | | |
|---|---|---|---|---|
| 2332287 | | 1/1975 | (DE) . | |
| 2181082 | | 4/1987 | (GB) . | |
| 61-147939 | * | 7/1986 | (JP) | 72/342.92 |
| 2-303647 | * | 12/1990 | (JP) | 72/342.7 |
| 4-100639 | * | 4/1992 | (JP) | 72/342.92 |
| 5-212485 | * | 8/1993 | (JP) | 72/342.7 |
| 6055230 | * | 3/1994 | (JP) | 72/342.92 |

OTHER PUBLICATIONS

Brandis/Funke, Nutzung des Kaltverfestigungsverhaltens nichtrostender Stahle beim Tiefziehen durch gezielte Temperaturfuhrung, pp. 75–86.
VDI nachrichten, Nr. 21/27. Mai 1977, S. 8–10.
Fertigungsmethoden fur Konservendosen. In: Technische Rundschau, Bern, Nr. 34, Aug. 21, 1979, S. 19, 21.
Hoffmann,: Herstellung von Konserven– und Getrankedosen, Handbuch der fertigungstechbnik, Bd. 2/3, S. 1224, 1225.

* cited by examiner

*Primary Examiner*—Lowell A. Larson
(74) *Attorney, Agent, or Firm*—Duane, Morris & Heckscher LLP

(57) ABSTRACT

A method is provided for ironing a cup to a selected wall thickness, using a mandrel that pushes the cup through several ironing rings that are axially aligned with the central axis of the mandrel. The method includes selecting a wall thickness, providing a resistive heater associated with at least one of the punch, the ram and the ironing rings, and controlling a gap between the punch and the ironing rings, and thus the wall thickness of the ironed can body, by setting a temperature of at least one of the punch, the ram and the ironing rings. The temperature is set by controlling electrical current in the resistive heater to provide a controlled gap between the mandrel and ironing rings, to produce a wall thickness of the ironed can body equal to the selected wall thickness when the can body is pushed through the ironing rings by the mandrel.

6 Claims, 4 Drawing Sheets

TEMPERATURE CONTROL DURING CAN BODY IRONING

BACKGROUND OF THE INVENTION

1. Field of the Invention

Figure 1:
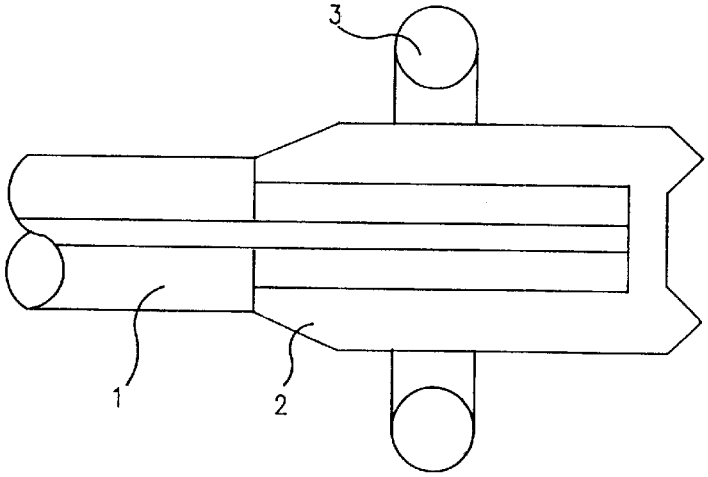

The technical field of the invention is a forming method for sheet met al cans made from aluminum or steel sheet or a combination of said both materials, said method being called "ironing". Said sheets may as well be provided with an additional functional co a ting (e. g. lamination or coat of varnish). In this technical field, ironed can bodies are obtained which in a closing process may be provided with can ends to obtain closed cans.

In said technical field, it is an object of the invention to reduce tool wear and to simultaneously save material.

SUMMARY OF THE INVENTION

According to the invention, this object is achieved by using at least one of a heated or a cooled punch and a heated or a cooled ram and heated or cooled ironing rings and heated or cooled process and supporting agents. Cooling or heating of said punch, ram, ironing rings and process and supporting agents may be controlled externally as well as by providing the ram, punch or ironing rings with an integrated heating or cooling means (claim 1, 4). The dimensions of the ironing tool are alterable by its temperature.

With a known tool temperature $THETA_{st}$ and a defined (i.e., selected) tool configuration (given clearance between ironing mandrel and ring), the ironed can presents a defined distribution of the wall thickness. A defined (controlled) heating or cooling of the tools results in an expansion or shrinkage, respectively, of the ironing mandrel and ring and a defined change of said clearance, thus achieving a controllable wall thickness or a change in the wall thickness distribution depending on the selected controlled temperature. Thus, according to the invention, the tool geometry is altered by influencing the temperature, which influence is principally avoided by prior art using a substantially constant cooling agent.

The present invention succeeds in compensating temperature influences and tool wear occurring during operation of an ironing press. Without said compensation, raising the cycle numbers of ironing machines would not be possible. Besides, the service life of each ironing tool is markedly prolonged, since tool wear may be compensated without being forced to use new tools. Said compensation permits longer-term usability of the same tool and, despite wearing of the tool material (mostly: hard metal), production of an ironed can with constant wall thicknesses remaining the same for a long term.

According to the invention, both, the forming behavior during forming of a seam and the forming behaviour during reducing the upper can edge diameter ("reduced neck" or "necking") are improved.

During trimming, material waste may be reduced. Also, the trimming process of the upper can edge may be improved with regard to accuracy.

By an additionally possible diminuation tightening of the window of dimensional tolerance, which can be effected for each reduction of the sheet thickness of a basic metal sheet, the thickness of the remaining wall portion of the can may—if using the invention—be reduced during necking of the upper can portion. According to prior art, diameter variation during reduction of the upper can portion from a main diameter to a reduced upper diameter ("necking") impedes a further reduction of the wall thickness.

The invention permits such an improvement in favor of material savings.

For compensating tool wear by using temperature influences, the invention uses a physical effect which, according to prior art, was undesired and avoided. In fact, prior art also uses cooling agents and lubricants which, with respect to the environment, present an elevated or reduced temperature; however, said temperature being at a constant level in order to avoid a change of a tool geometry as now intended by the invention. The can wall thickness is measured in contact or contactless and may be controlled by tracking or adjustment or may be "feedbackcontrolled" to remain at constant values, by altering the temperature of the tools (claim 9).

DETAILED DESCRIPTION OF THE PREFERRED EMBODIMENTS

The following embodiments of the invention are intended to give a more detailed and complete comprehension of the invention.

FIG. 1 In the first embodiment according to the invention, a punch 2 or a ram 1 are heatable by gas-fired ring nozzles. The same arrangement may serve for heating or cooling with a fluid.

Figure 2:
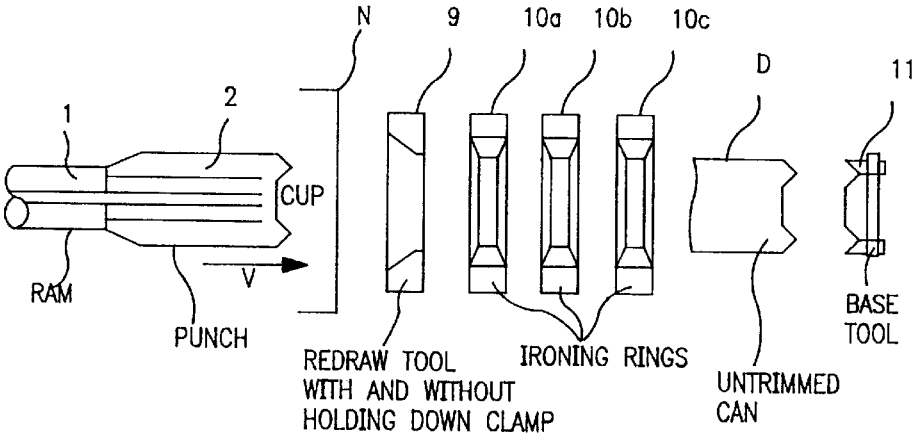

FIG. 2 FIG. 2 shows a punch 2 being fixed on a ram 1 by a so-called punch screw. The ironing principle shown here corresponds to prior art.

Figure 3:
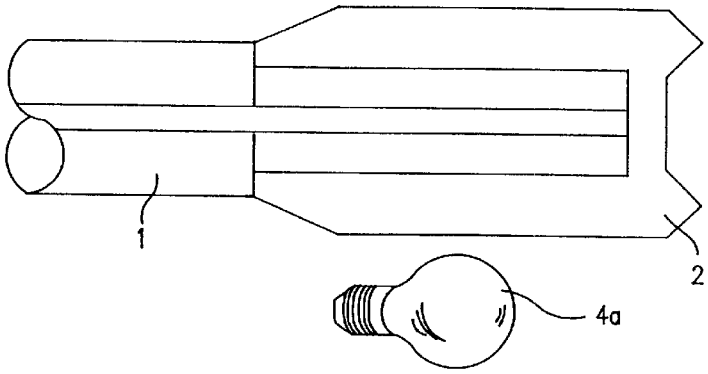

FIG. 3 The heating of a punch 2 or a ram is also possible by external influence of radiation. In FIG. 3, for example, illustrates an external infrared radiator 4*a*.

Figure 4:
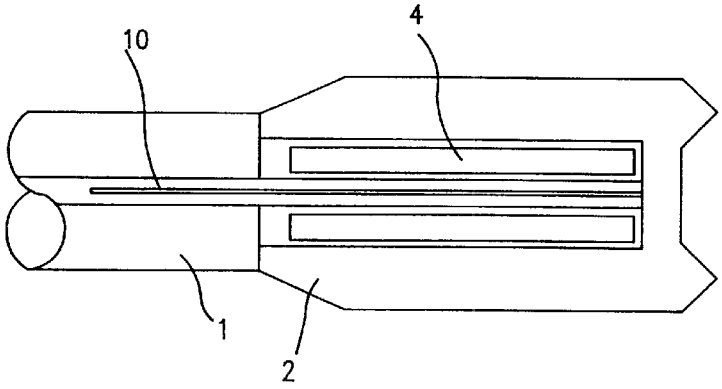
Figure 5:
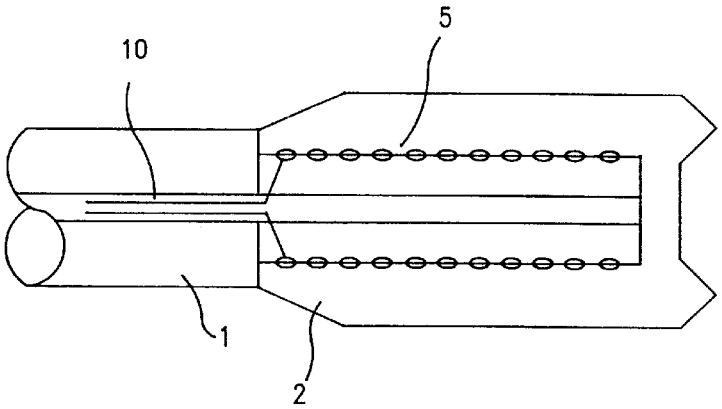
Figure 6:
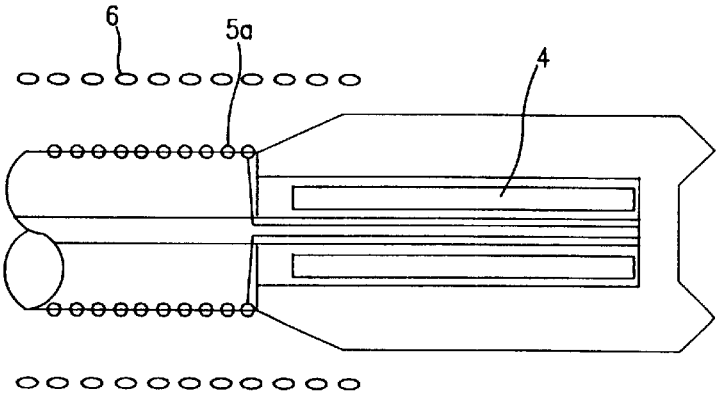

FIGS. 4, 5, 6 Heating is effected with the help of heating cartridges or heating resistors 4 (FIG. 4) according to the physical principle of a resistance heating. Heating can also be be made with helical pipe cartridges or spiral heating elements 5, also being a resistance heating principle (FIG. 5). The heating cartridges according to FIG. 6 are inserted in said ram 1, an integration of the heating cartridges in a punch 2 also being possible.

Cables 10 are used for electric power supply.

Using an induction method (coil arrangement 6) for an electric power supply is possible to spare the conductors. In this embodiment, said helix 5 in the tool would have to be shorted then.

Coils 6 may be arranged between said ironing rings 10*a*, 10*b*, 10*c* (instead of spacers), they may as well be arranged in front of and/or behind said ring arrangement (compare FIG. 1).

Figure 7:
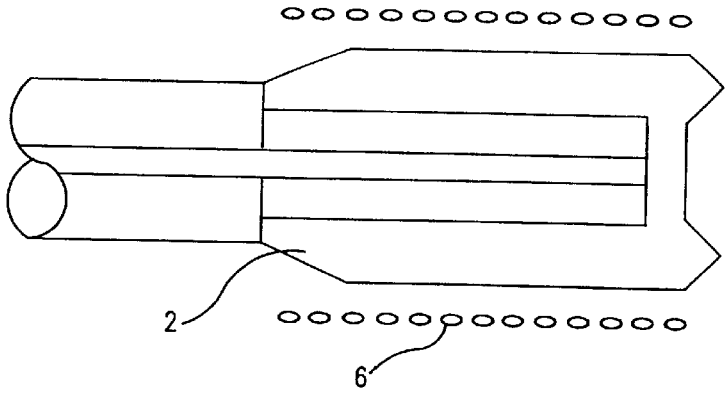

FIG. 7 Heating of said punches 2 is also possible by an external coil arrangement 6, said punch or ram being heated by induction.

Figure 8:
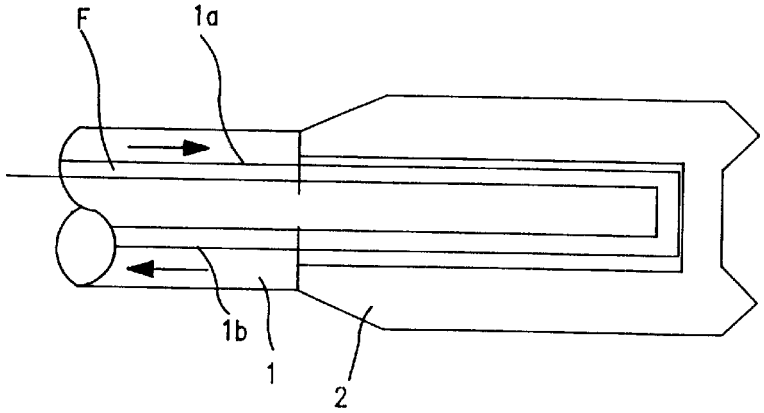

FIG. 8 Said punch or ram may as well be cooled or heated by leading fluids through them. FIG. 8 shows a ram 1 with integrated conduits 1*a*, 1*b* through which said cooling or heating fluid may be led.

Figure 9:
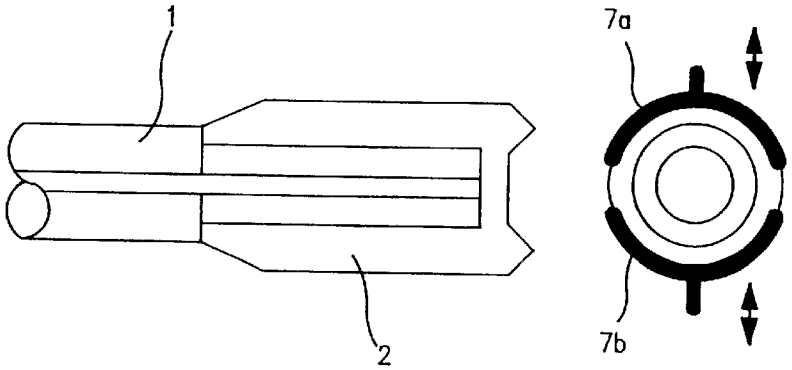

FIG. 9 Said punch or ram is cooled or heated by curved contact plates 7*a*, 7*b*.

Figure 10:
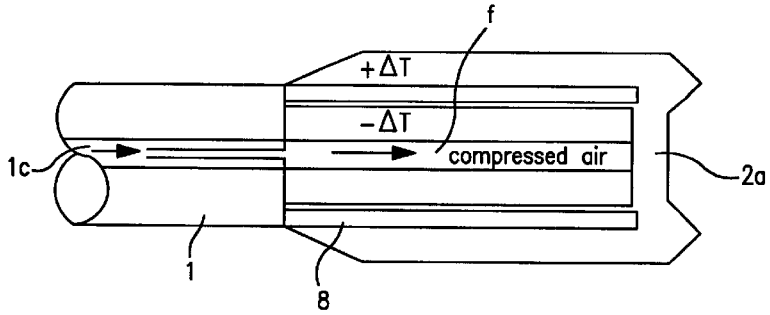

FIG. 10 Said forming tools and said ram, respectively are cooled or heated by using the Peltier effect with Peltier element 8. The temperature is adjusted by a defined alteration of a current I or by alteration of a flow medium F inside said ram in a central conduit 2*a*, 1*e*.

Figure 11:
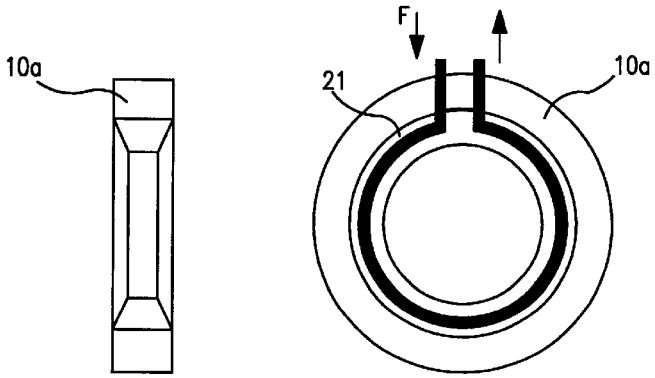

FIG. 11 A heated or cooled fluid F flows around or through at least one ring 10*a*, 10*b*, 10*c*. For this purpose, ring conduits are provided in or at said ironing ring (e. g. 10*a*).

Figure 12:
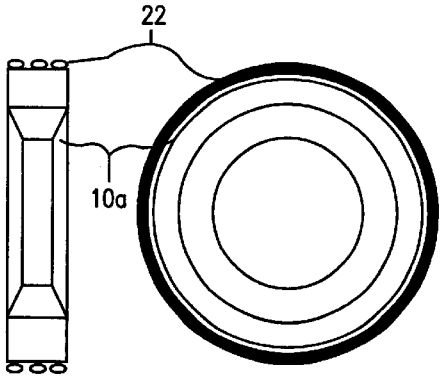

FIG. 12 At least one ring 10*a*, 10*b*, 10*c* is heated by helical pipe resistors 22 or the heat is carried off by cooling spirals 22.

Figure 13:
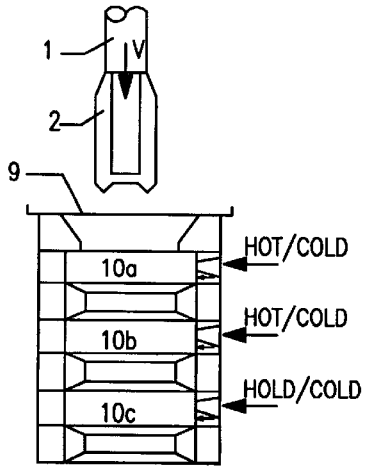

FIG. 13 Process and supporting agents ("forming fluids") of an "ironing press system" are cooled or heated to benefit from different expansion coefficients of ironing rings and punches.

Heating or cooling of said ram 1 or punch 2 and/or of said ironing rings by at least one venturi cartridge is disclosed without Figures, a temperature change being achieved by a defined alteration of the cross sections of a gas flow (Thomson Joule effect).

The temperature range suitable for use to control the tool dimensions (e. g. diameter) is between −20° to 250° C. (said temperature range being limited by previous tool fatigue and tool rupture).

1° C. changes the diameter of the ironing mandrel by 0.8 μm, e. g. in case of hard metal being the tool material. This gives the corresponding alteration of the wall thickness of the ironed sheet metal can or corresponds to the extent of diameter compensation.

If the amount of wear is known during a longer term tool use—in case of known tool-temperature behaviour—, the temperature of the forming tools may be long-term altered by characteristic lenses (to read correctly: characteristic curves). Thus, a continuous tool wear is compensated on a long term continuous basis.

Besides said compensation, short-term tool dimensions (ring diameter, mandrel diameter, corresponding diameter steps or different diameters of successive rings) may be altered without removal or change of the tools.

A temperature control of tools for altering their dimensions is helpful for production as well as for research and development.

What is claimed is:

1. Method for ironing a cup with a mandrel having a central axis and comprising a punch and a ram, during said ironing pushing the cup with the mandrel through several ironing rings, axially aligned with respect to the central axis of the mandrel to form an ironed can body having a wall thickness, the method comprising:

selecting a selected wall thickness of said ironed can body;

providing a resistive heating means associated with at least one of the punch, the ram and the ironing rings;

controlling a gap between the punch and the ironing rings by setting a temperature of at least one of the punch, the ram and the ironing rings, said temperature being set by setting an electrical current in said resistive heating means, said controlled gap corresponding to said selected wall thickness so that the wall thickness of the ironed can body formed by pushing the mandrel through ironing rings corresponds to said selected wall thickness.

2. The method according to claim 1, wherein the can wall thickness is measured for controlling at least one of alteration of the can wall thickness and maintaining constant can wall thickness.

3. The method of claim 2, wherein by a controlled alteration of the tool temperature the can wall thickness is altered or maintained constant.

4. The method of claim 2, wherein the measurement of the thickness is oriented in radial direction.

5. The method of claim 1 wherein the electrical current in said resistive heating means is induced by an induction coil.

6. Ironing tool for ironing a cup, the tool having a mandrel having a central axis and comprising a punch and a ram, for pushing the cup with the mandrel through a plurality of ironing rings, axially aligned with respect to the central axis of the mandrel to form an ironed can body having a wall thickness, wherein:

(a) at least one of said ironing rings is electrically heatable by heating means controlled electrically through cables; and (b) the mandrel of said ironing tool is electrically controllable in a temperature of said ironing tool, whereby heating of said at least one of said ironing rings and control of the temperature of the mandrel influences dimensioning of said tool without mechanical engagement.

* * * * *

UNITED STATES PATENT AND TRADEMARK OFFICE

CERTIFICATE OF CORRECTION

PATENT NO. : 6,263,718 B1
DATED : July 24, 2001
INVENTOR(S) : Buse et al.

It is certified that error appears in the above-identified patent and that said Letters Patent is hereby corrected as shown below:

Title page,
Item [73], Assignee, delete "Schmalbac" and insert therefor -- Schmalbach --

Signed and Sealed this

Twenty-sixth Day of February, 2002

*Attest:*

*Attesting Officer*

JAMES E. ROGAN
*Director of the United States Patent and Trademark Office*